US005839891A

United States Patent [19]

Cook

[11] Patent Number: 5,839,891

[45] Date of Patent: Nov. 24, 1998

[54] POWER GAS BURNER

[75] Inventor: Richard D. Cook, Avon, Ohio

[73] Assignee: Beckett Gas, Inc., North Ridgeville, Ohio

[21] Appl. No.: 782,778

[22] Filed: Jan. 13, 1997

[51] Int. Cl.[6] ..... F23D 3/40

[52] U.S. Cl. ..... 431/7; 431/159; 431/347; 431/350; 431/354

[58] Field of Search ..... 431/7, 9, 8, 159, 431/326, 328, 329, 348, 347, 350, 351, 354

[56] References Cited

U.S. PATENT DOCUMENTS

| | | | |
|---|---|---|---|
| 0,266,889 | 10/1882 | Requa . | |
| 1,729,149 | 9/1929 | Brown et al. . | |
| 2,059,523 | 11/1936 | Hepburn et al. . | |
| 3,809,887 | 5/1974 | Ehrlichmann . | |
| 4,383,820 | 5/1983 | Camacho | 431/8 |
| 4,383,824 | 5/1983 | Findlay et al. | 431/353 |
| 4,397,631 | 8/1983 | Fisher | 431/350 |
| 4,525,141 | 6/1985 | DeWerth et al. . | |
| 4,619,604 | 10/1986 | Pickering . | |
| 4,629,415 | 12/1986 | DeWerth et al. . | |
| 4,676,199 | 6/1987 | Daugirda et al. . | |
| 4,776,320 | 10/1988 | Ripka et al. . | |
| 4,850,334 | 7/1989 | Cassagne et al. . | |
| 4,902,222 | 2/1990 | van Belle . | |
| 4,915,621 | 4/1990 | Schilling et al. . | |
| 4,960,102 | 10/1990 | Shellenberger . | |
| 4,978,293 | 12/1990 | Ryno . | |
| 5,015,174 | 5/1991 | Dreizler et al. | 431/351 |
| 5,085,205 | 2/1992 | Hall et al. . | |
| 5,174,744 | 12/1992 | Singh . | |
| 5,197,665 | 3/1993 | Jenson et al. . | |
| 5,622,491 | 4/1997 | Van Belle | 431/347 |

FOREIGN PATENT DOCUMENTS

| | | |
|---|---|---|
| 0009831 | 4/1980 | European Pat. Off. . |
| 0172945 | 3/1986 | European Pat. Off. . |
| 1117749 | 6/1968 | United Kingdom . |
| 1462985 | 1/1977 | United Kingdom . |
| 1579829 | 11/1980 | United Kingdom . |

*Primary Examiner*—James C. Yeung
*Attorney, Agent, or Firm*—Watts, Hoffmann, Fisher & Heinke, Co. L.P.A.

[57] ABSTRACT

A gas burner produces a homogeneous mixture of gas and air in a short mixing zone by creating turbulence to promote thorough mixing. The burner includes a burner housing supporting a gas distribution tube and an air blower, the distribution tube emitting jets of gas in a radial direction and supporting a baffle plate having a plurality of openings. Air from the blower impinges on the jets of gas to form streams of gas and air that pass through the openings in the baffle plate. A diffuser ring is disposed downstream from the baffle plate and extends radially inward to form a flow constriction. The streams of gas and air contact the diffuser ring and undergo turbulence and the resulting mixture of gas and air passes through the diffuser ring and expands within the interior of a perforated combustion head. The mixture passes through the perforations and when ignited obtains combustion of nearly 100% of the gas and produces a very even flame profile. The burner is easy to manufacture and operates well at very low gas pressures.

27 Claims, 8 Drawing Sheets

POWER GAS BURNER

BACKGROUND OF THE INVENTION

1. Field of the Invention

The present invention relates to gas burners and, in particular, a power gas burner that produces a homogeneous mixture of gas and air for combustion.

2. Description of Related Art

Gas burners for use in furnaces, water heaters or other gas appliances are known in the art. Many styles of burners mix gas, e.g., natural or LP gas, with air received from a fan or blower to form a mixture that is fed to a combustion head and ignited to form a flame along or adjacent to the combustion head. A power gas burner uses a motor driven air blower to provide some or all of the air needed for combustion. Conventional gas burners have suffered from various drawbacks which those in the art have sought to overcome. For example, some prior art burners do not completely combust all of the gas supplied to the burner. That is, although the gas and air mix sufficiently to ignite and produce a flame, some of the gas remains unburned and is vented along with the combustion products. This wastes gas and increases the cost of obtaining sufficient heat needed to operate the appliance with which the burner is utilized.

In addition, the goal of obtaining good mixing of the gas and air has led some in the art to increase the length of the combustion head or burner to increase the time during which the flowing gas and air may mix. In conventional burners, the length of the mixing chamber, as defined between the location at which the gas is emitted into the burner and the location at which the gas and air are substantially thoroughly mixed for combustion, can be as much as ten times as large as the diameter of the mixing chamber. Consequently, manufacture of the burner requires a considerable amount of material which increases its size and cost. The increased size can present problems by limiting flexibility in utilizing the burner with various gas appliances.

Some power gas burners are of the type that achieve gas-air mixing in a blower housing, i.e., the gas and air are fed into a motor driven blower to be mixed and then directed to the combustion head. This type of burner presents additional problems because it requires a relatively complicated and expensive sealing structure to ensure against gas leakage out of the blower. As such, manufacturing such a burner typically is difficult and expensive.

Conventional gas burner designs also have attempted to produce an even, stable flame at the burner head, a desirable but often difficult feature to obtain. Prior art burners have included various devices to produce a stable flame that does not vary significantly along the length or around the burner head. For example, some burners have been provided with special inserts, e.g., cone-shaped orifice liner elements, in the burner to manipulate the flow of gas and air in order to obtain a relatively even flame profile. Including special inserts in the burners makes their manufacture more involved and costly.

Accordingly, there is a need in the art for a gas burner that is easier and less expensive to manufacture than prior art burners, yet thoroughly mixes gas and air to achieve combustion of a high percentage of gas and a stable, even flame profile.

SUMMARY OF THE INVENTION

The gas burner of the present invention overcomes the problems and shortcomings of the prior art by obtaining very thorough mixing of gas and air which results in nearly 100% combustion of gas and a stable, even flame profile. The burner does not require a large chamber or zone to mix the gas and air, nor does it require special inserts to produce an even flame profile; thus, manufacture of the burner is relatively simple and inexpensive. Further, the gas and air are mixed within the burner combustion head so that no intricate air housing or blower seals are needed; in addition, the pressure within the burner combustion head preferably decreases in a downstream direction which also prevents leakage of gas from the burner.

In a preferred embodiment, the burner includes a burner housing having an interior and an air blower that directs pressurized air into the housing interior. A gas manifold receives gas from a supply and has an outlet that emits gas through a plurality of openings in a generally radial direction into the interior of the combustion head. A baffle is disposed next to the manifold outlet and extends generally radially and includes a plurality of openings disposed around the openings in the manifold outlet. Air from the air blower enters the housing and is directed to the entrance of the burner combustion head where it begins mixing with gas emitted from the manifold outlet openings to form streams that pass through the openings in the baffle. A diffuser is disposed downstream of the baffle and contacts the streams of mixing gas and air to create turbulence and promote thorough mixing. The thoroughly mixed gas and air passes through the perforated portion of the combustion head and when ignited produces an even, stable flame. The combustion head may be integral with the burner housing or a separate element attached thereto.

In more specific preferred embodiments, the gas manifold comprises a gas distribution tube with a collar attached thereto including a plurality of radial openings, and the baffle is a flat plate with circular openings formed therein. The diffuser is preferably a ring that extends radially inward from an interior of the combustion head to form a flow constriction that creates turbulence in the gas and air passing through the baffle plate, resulting in a substantially homogeneous mixture. The baffle plate is secured to the collar for ease of manufacturing and each of the openings in the baffle plate is aligned with a corresponding opening in the collar. For optimum mixing, the number of openings in the gas manifold outlet is the same as the number of openings in the baffle plate. Also, it is preferred to orient the diffuser so that it extends radially inward and necks toward the baffle.

In addition, the gas manifold preferably comprises a gas distribution tube which includes a first section defining a gas inlet detachably secured to a second section defining a gas outlet. A flow control member is provided in the distribution tube to regulate the flow of gas. Although a single tube could be used, a two-section distribution tube is preferred because it permits a flow control member to be removably positioned between the first and second sections. The flow control member preferably is an orifice member with an exterior configured for receipt within one of the tube sections. Thus, a plurality of interchangeable gas flow control members having different size flow orifices can be provided to selectively vary flow through the gas distribution tube.

According to the invention, a process for producing a substantially homogeneous mixture of gas and air in a burner includes steps of providing a burner including a burner housing having an interior that communicates with a combustion head, feeding gas through a gas distribution manifold into the interior of the combustion head so as to exit in a generally radial direction, forcing pressurized air into the combustion head so as to flow in a generally axial direction and mix with the gas exiting the manifold, directing the mixing gas and air through the openings of a baffle to reduce the pressure thereof and then against a diffuser which creates turbulence to produce a substantially homogeneous mixture of gas and air.

Other features, benefits and advantages of the invention will become apparent from the following detailed description of preferred embodiments thereof taken in conjunction with the following drawing figures.

BRIEF DESCRIPTION OF THE DRAWINGS

5

DETAILED DESCRIPTION OF PREFERRED EMBODIMENTS

Figure 1:
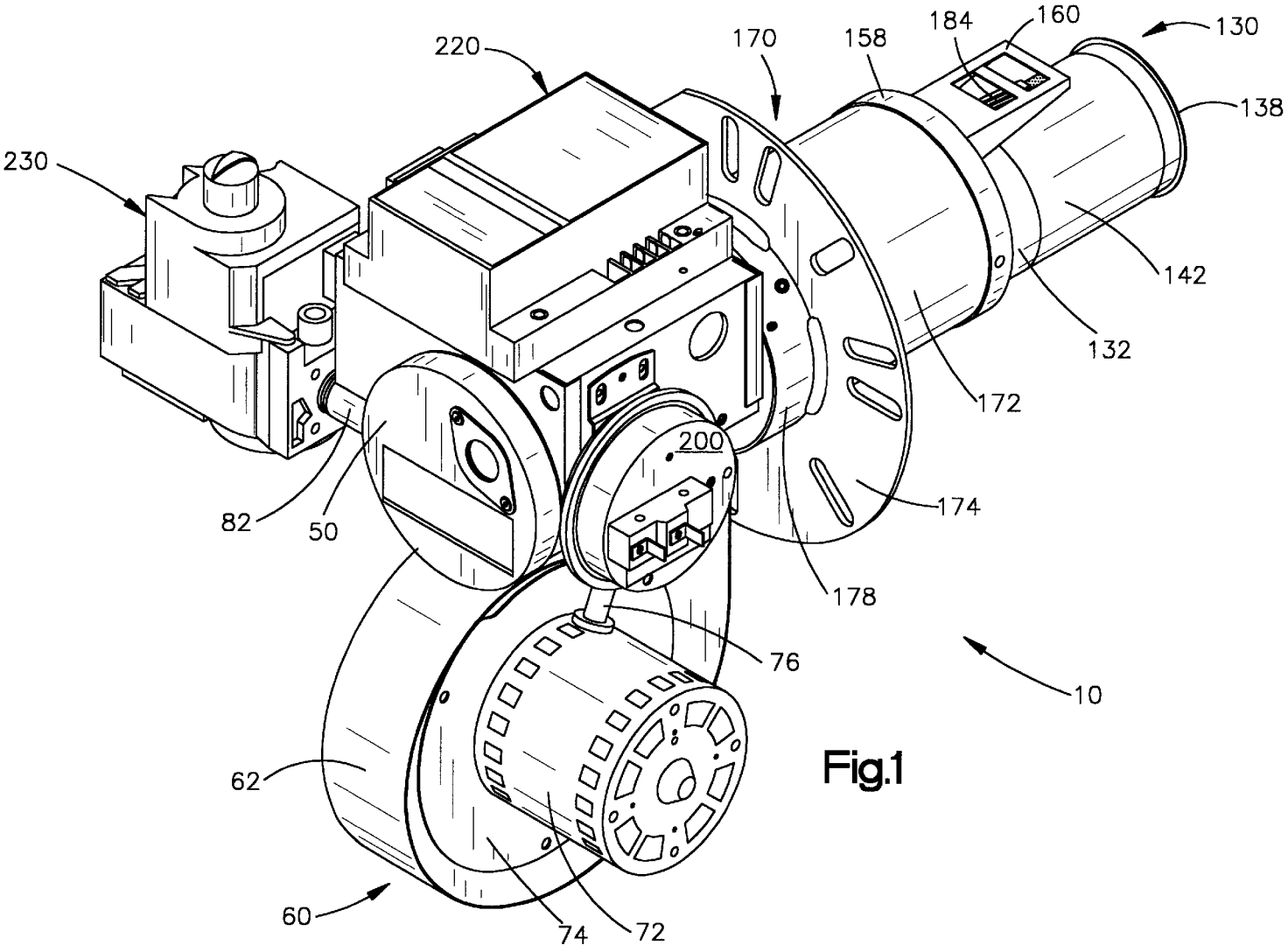
FIG. 1 is a perspective view of a gas burner constructed according to a preferred embodiment of the invention.
Figure 2:
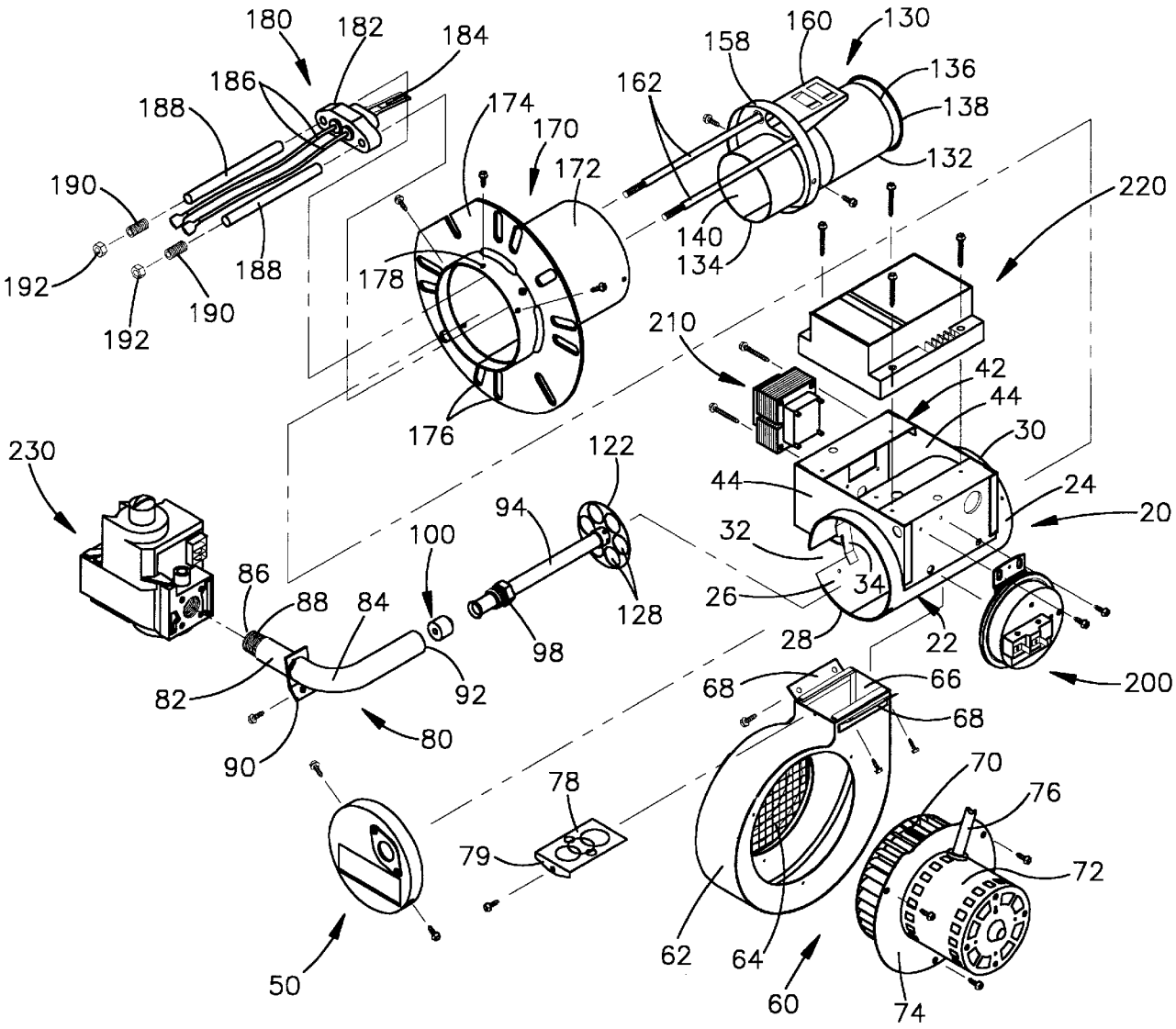
FIG. 2 is an exploded perspective view of the gas burner shown in FIG. 1.
Figure 3A:
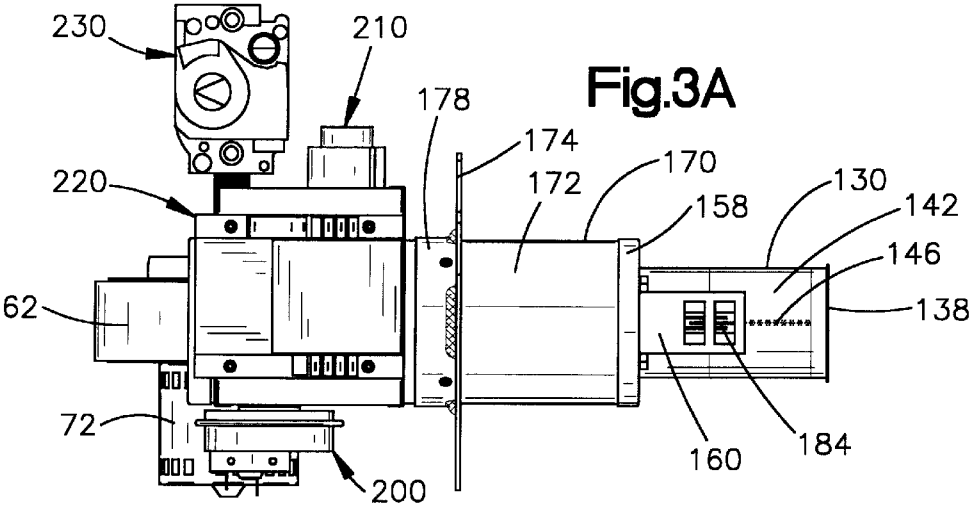
FIGS. 3A–3C are, respectively, plan, front elevational and side elevational views of the gas burner shown in FIG. 1.
Figure 3B:
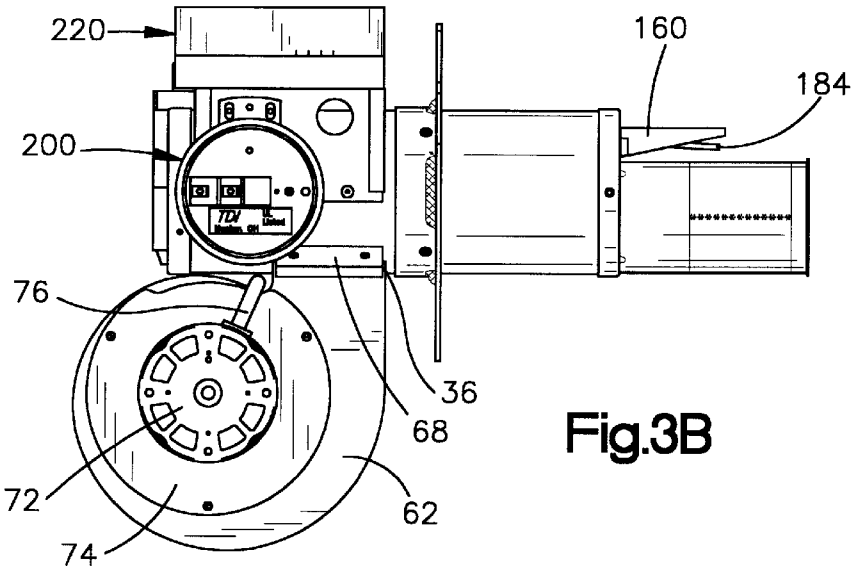
Figure 3C:
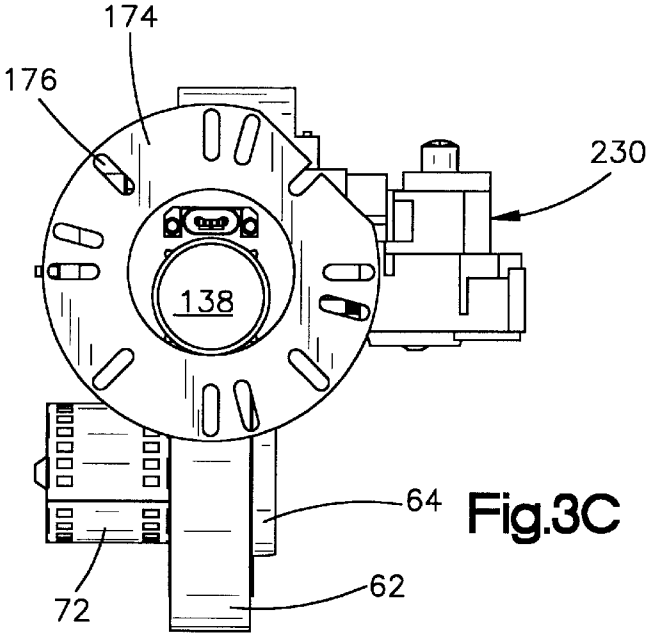

With reference to FIGS. 1 and 2, a gas burner constructed according to a preferred embodiment of the invention is shown and designated generally by the reference numeral 10. The burner 10 is a power gas burner as it utilizes a motor driven fan or blower to provide air that is mixed with gas to produce a combustible mixture of gas and air. In its preferred mode of operation, the inventive burner is of the pre-mix type, i.e., the air needed for combustion is provided by a blower and is completely mixed with gas prior to combustion. However, it should be recognized that the invention may be used in gas appliances that do not operate in a pre-mix mode. Further, the burner of the invention may be connected to any gas appliance, e.g., furnaces, water heaters, etc. As such, the invention is not limited in use to any specific mode of operation or particular type of appliance.

The burner 10 includes a burner housing which in the preferred embodiment is designated by reference numeral 20 and comprises two components, namely, a burner body 22 and an electrical connection box 42. The burner body 22 preferably is cylindrical with an exterior surface 24, a hollow interior 26, and a pair of opposite open ends 28 and 30. The body 22 has a slot 32 and a mounting portion 34 for mounting a gas distribution manifold, as discussed below. An opening 36 is formed in the lower portion of the burner body 22 for mounting an air blower, as discussed below. The burner body 22 may comprise sheet metal or any other suitable material that is formed in a cylindrical or other desired configuration.

The burner body 22 is provided with an enclosure for mounting electrical components of the burner, the enclosure being formed separately and attached to, or alternatively formed integrally with, the burner body 22. In the preferred embodiment the enclosure is in the form of an electrical connection box 42 that is attached to the burner body 22 and mounts various electrical components of the burner 10. As best seen in FIGS. 2 and 6A–6D, the electrical connection box 42 includes a pair of side panels 44 each having a cutout portion 46 configured to mate with the exterior 24 of the burner body 22, and a pair of opposite end panels 48 and 50. The box 42 is provided with a pair of top panels 52 and a lower panel having a downturned flange 56. The flange 56 preferably is arcuate so as to mate with the burner body 22 and the mounting flange of the air blower, as discussed below. The end panel 48 includes a cut-out or window 54 which mounts a transformer 210, while the end panel 50 includes apertures 51 for mounting an air pressure/proving switch 200. The function of the transformer 210 and switch 200 is described below. Similarly, the top panels 52 include apertures 53 for securing a gas ignition control device 220, the function of which is described below as well. The end panel 50 also preferably has openings for receiving fasteners that engage corresponding openings in the burner body 22 to secure the components together. For manufacturing reasons, the electrical connection box 42 is formed of several pieces of sheet metal or other relatively strong material joined together by any suitable connections, such as spot welds; however other constructions could be used. The resulting structure provides a relatively stiff, box-like configuration that seats against the upper portion of the burner body 22.

Figure 8A:
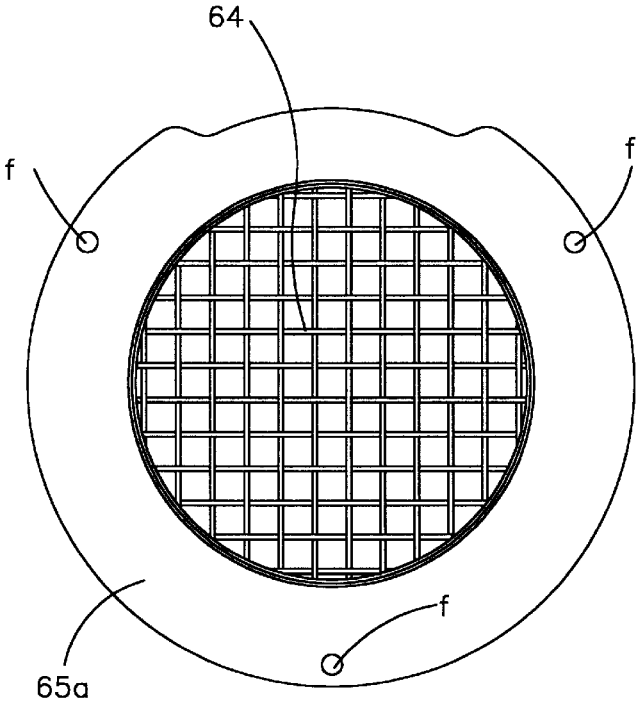
FIGS. 8A and 8B are, respectively, front and side elevational views of an inlet screen forming part of the air blower shown in FIG. 1.
Figure 8B:
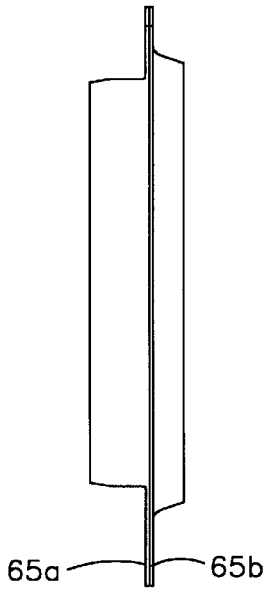

The burner 10 includes an air blower or fan for providing pressurized air that is mixed with gas. In the preferred embodiment, an air blower 60 is provided the components of which are shown in FIGS. 2, 7A, 7B, 8A, 8B, 9A, 9B and 10. The air blower 60 is attached to the burner housing 20 and includes a blower housing 62 provided with an air inlet screen 64 and an air outlet 66 for forcing air into the burner housing 20. The blower housing 62, which may be of the squirrel cage type shown in the drawings, is hollow and includes opposite walls 62*a*, 62*b*, each of which is provided with an open area 63. The inlet screen 64 preferably comprises opposite panels 65*a*, 65*b* joined, for example, by spot welds, with a screen positioned between the panels. The panels 65*a*, 65*b* have openings f formed therein for receiving fasteners that engage corresponding openings f formed in the sidewall 62*a* of the housing 62. As seen in FIG. 8B, the panel 65*a* faces away from the blower housing and provides a collar that may be used to connect the inlet to vents, ducts, etc. The panel 65*b* includes an inlet bell portion that is received adjacent to the blower wheel 70. The inlet screen 64 thus is secured to the housing 62 so as to cover the open area 63 in the housing sidewall 62*a*.

Figure 9A:
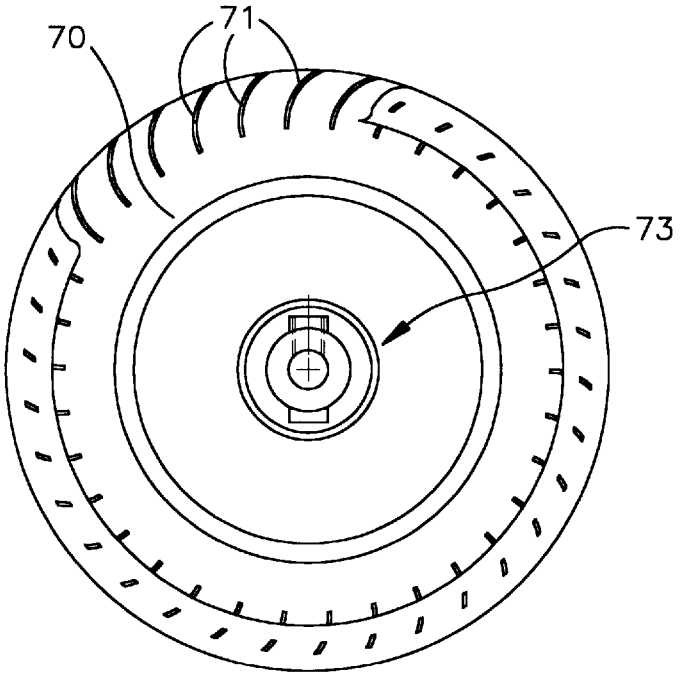
FIGS. 9A and 9B are, respectively, a front elevational view and a side elevational view in section of a blower wheel forming part of the air blower shown in FIG. 1.
Figure 9B:
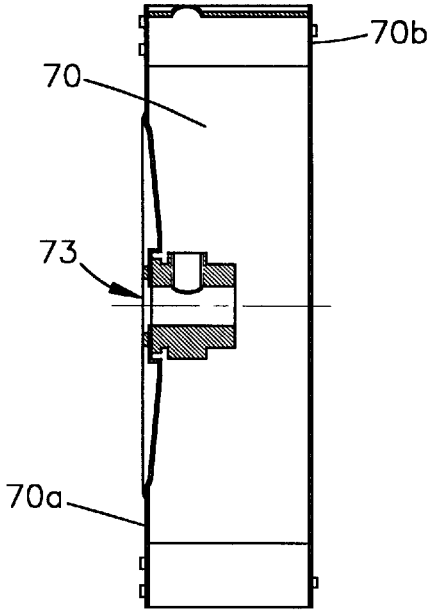
Figure 10:
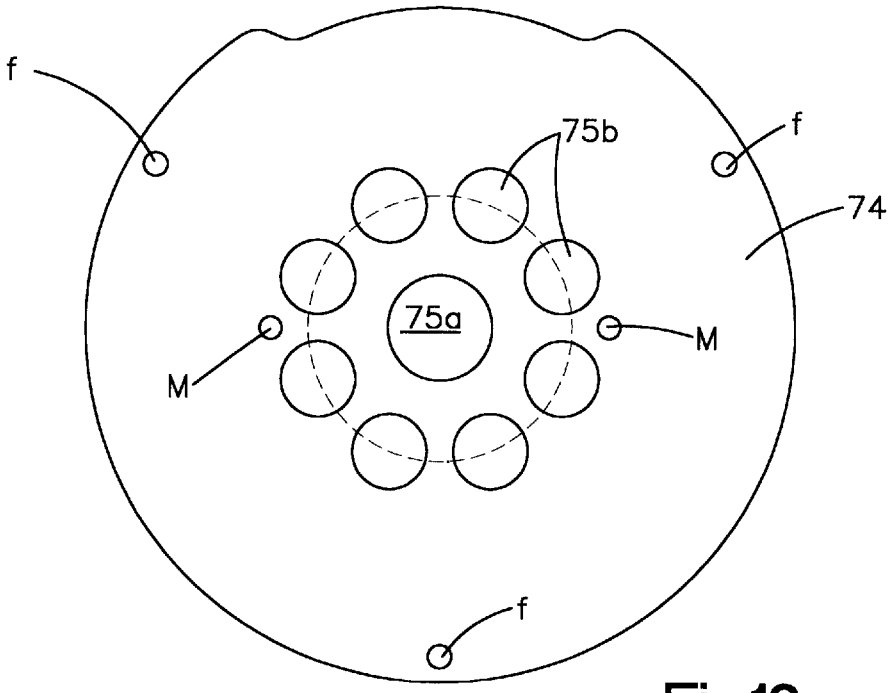
FIG. 10 is a front elevational view of a motor mounting plate forming part of the air blower shown in FIG. 1.

As seen in FIGS. 9A and 9B, the air blower 60 includes a blower wheel 70 having a plurality of vanes or blades 71. The blower wheel 70 has a sidewall 70*a* preferably extending inward to a hub indicated generally by reference numeral 73. The hub 73 is engaged and rotated by the drive shaft (not shown) of a motor 72. The side of the blower wheel opposite sidewall 70 is open and bounded by a peripheral edge 70*b*, the inlet bell of the air inlet panel 65*b* being received closely adjacent to the edge 70*b*. The motor 72 is secured to a motor mounting plate 74 (FIG. 10) having openings m that receive fasteners securing the motor 72 to the plate 74. When secured together, the motor drive shaft passes through the central aperture 75*a* formed in the mounting plate 74 and engages the hub 73 of the blower wheel 70. Also, the mounting plate 74 may include optional cooling apertures 75*b* surrounding the aperture 75*a*. The motor mounting plate 74 has openings f formed therein for receiving fasteners that engage corresponding openings f formed in the sidewall 62*b* of the blower housing 62, thereby fixing the motor 72 and blower wheel 70 to the housing 62. Suitable wiring such as a cord 76 may be provided to conduct current to the motor 72 to rotate the blower wheel 70 and force pressurized air through the outlet 66.

The upper end of the blower housing 62, adjacent to the air outlet 66, has a pair of mounting flanges 68*a*, 68*b* for attaching the blower housing 62 to the burner body 22 and the electrical connection box 42, and a pair of guides 69 for receiving an air metering plate 78. The air outlet 66 of the blower housing 62 is positioned in the opening 36 formed in the lower portion of the burner body 22 with the mounting flanges 68*a*, 68*b* abutting the exterior 24 of the body 22. The downturned flange 56 of the electrical connection box 42 conforms to the exterior of the burner body 22 and its end portion is positioned between the flange 68*a* and the exterior of the burner body. The mounting flanges 68*a*, 68*b* are secured to the burner housing 20 by any suitable connecting means, for example, fasteners engaging corresponding openings formed in the flanges 68*a*, 68*b*, the flange 56 of the electrical connection box 42, and the burner body 22. As a result, the burner body 22, the connection box 42 and the air blower 60 are securely fastened together. Operation of the motor 72 rotates the blower wheel 70 and air drawn through the inlet screen 64 is forced through the outlet 66 into the interior 26 of the burner body 22.

An air metering plate 78 is attached to the blower housing 62 and overlies the air outlet 66 to regulate the flow of air from the blower 60 into the burner body 22. As seen in FIG. 2, the air metering plate 78 has a flange 79 connected to the exterior of the burner housing 62. The blower housing 62 preferably is provided with guides 69 (FIG. 7B) that slidably receive the edges of the metering plate 78 to maintain the plate in proper position. The plate preferably is formed of aluminized steel and includes one or more openings for regulating air flow into the burner body 22. The size, number and/or location of the openings in the plate may be selected depending on the specific application. That is, a desired rate of air flow may be achieved in various manners, such as by using a particular size or number of openings, or by changing the location of the openings in the plate 78. An end cap 50 is fastened over the open end 28 of the burner body 22 and the pressurized air from the blower 60 passes into the burner body 22 and toward a combustion head, as discussed below.

Figure 5A:
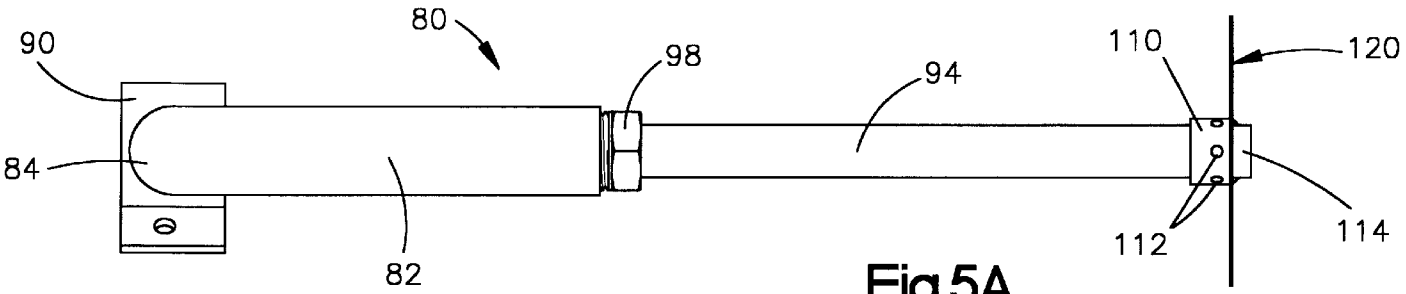
FIGS. 5A–5C are, respectively, a front elevational view, an exploded front elevational view partly in section, and a side elevational view of a gas distribution tube and baffle forming part of the gas burner shown in FIG. 1.
Figure 5B:
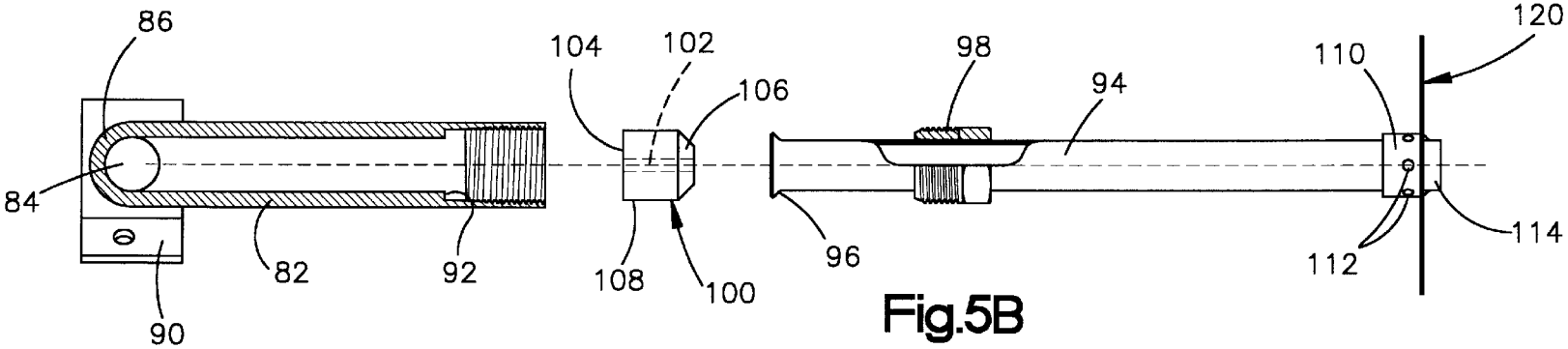
Figure 5C:
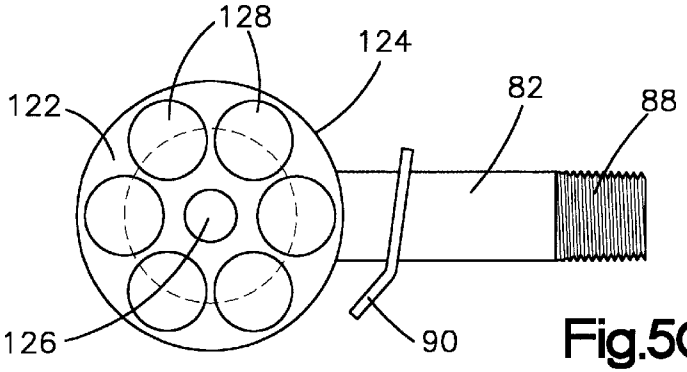
Figure 6B:
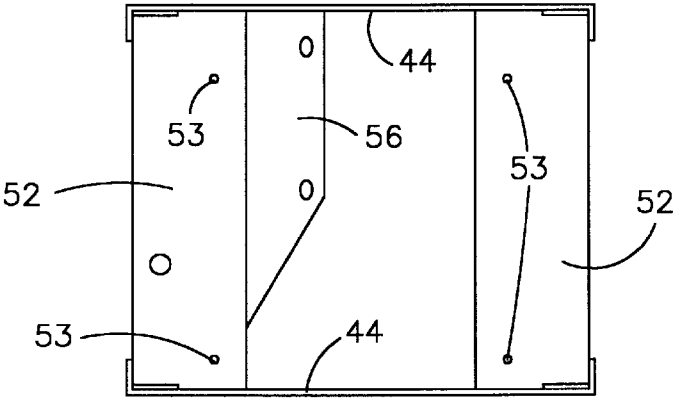
FIGS. 6B–6D are, respectively, plan, front elevational and side elevational views of the electrical connection box shown in FIG. 6A.
Figure 6D:
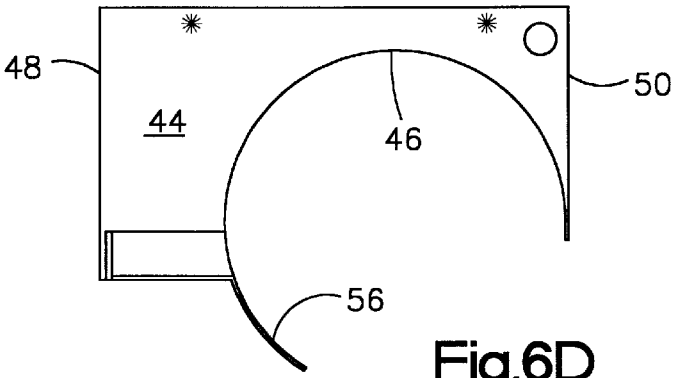
Figure 6A:
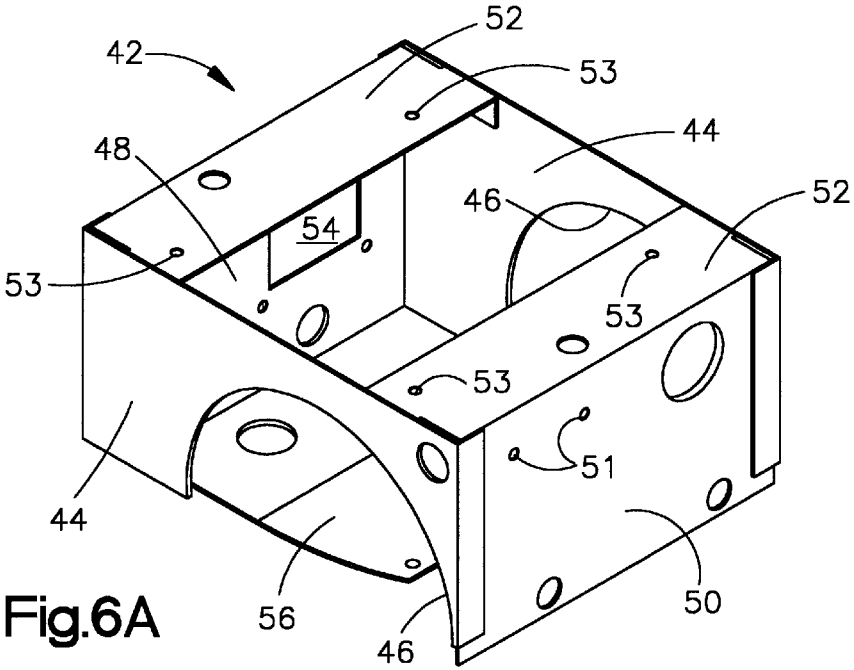
FIG. 6A is a perspective view of an electrical connection box forming part of the gas burner shown in FIG. 1.
Figure 6C:
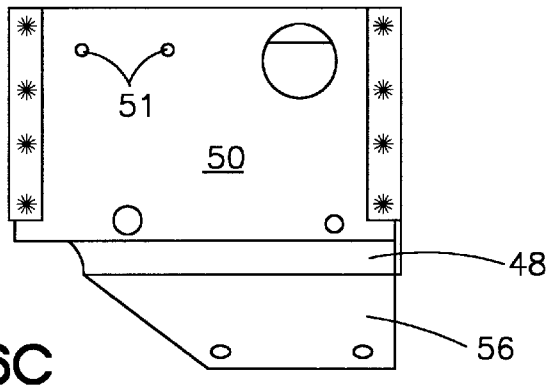
Figure 7A:
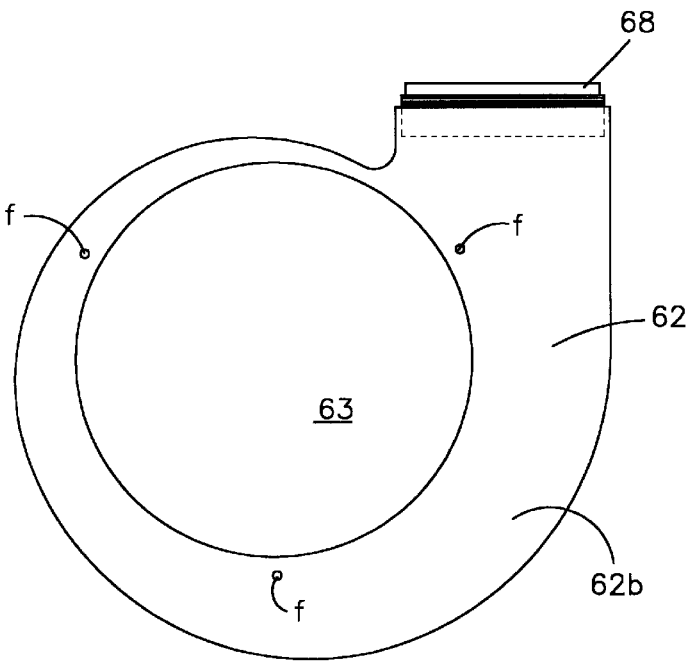
FIGS. 7A and 7B are, respectively, front and side elevational views of a blower housing forming part of the air blower shown in FIG. 1.
Figure 7B:
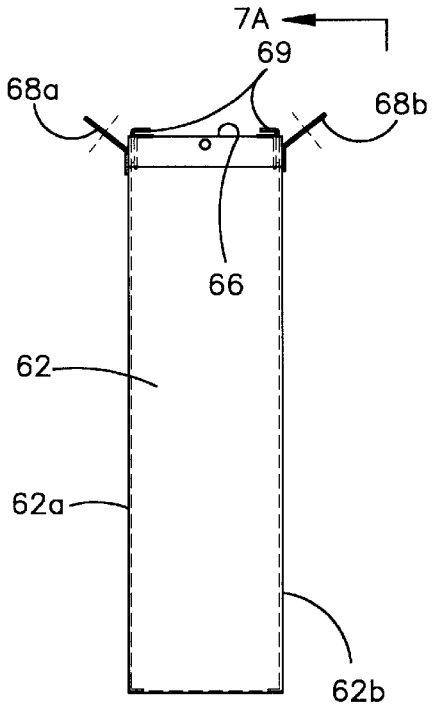

The burner 10 is provided with a gas distribution manifold that conveys gas which is to be mixed with air delivered by the air blower 60. In the preferred embodiment, as shown in FIG. 2, the gas distribution manifold is in the form of a gas distribution tube indicated generally by the reference numeral 80 that receives gas from a supply (not shown), the pressure of the supplied gas being regulated to a desired operating pressure by a valve 230. It should be recognized that structures other than a tube may be used to distribute the gas. The distribution tube 80 delivers the gas to an outlet where it is emitted and mixed with air from the blower 60; the mixed gas and air then passes through the combustion head and is ignited, as discussed below. The distribution tube 80 preferably includes a first tube section 82 joined to a second tube section 94. The tube section 82 is bent 90° as shown at 84 and includes a gas inlet end 86 having screw threads 88, a bracket 90, and an opposite recessed end 92 having internal threads. See FIGS. 5A and 5B. The second tube section 94 has a flared end 96 and a locking nut 98 slidably disposed thereon for securing the sections together.

A gas flow control member is disposed between the first tube section 82 and the second tube section 94 to control the flow of gas to the burner. A two section distribution tube is preferred because it may be disassembled to permit the gas flow control member to be changed to adjust the flow of gas into the burner, as explained below; however, a one-piece distribution tube may be used if it is not desired to adjust the gas flow, or if an alternative flow control mechanism is used which permits adjustment of the gas flow in a one-piece distribution tube.

In the preferred embodiment, the flow control member is in the form of a tubular orifice member 100 including a bore or orifice 102, a first end 104 and a second end 106. As seen best in FIGS. 4 and 5B, the exterior of the orifice member 100 is configured to be slidably received in the recessed end 92 of the first tube section 82. The tapered end 106 of the orifice member 100 is configured to be engaged by the interior of the flared end 96 of the second tube section 94, such that when the respective tube sections 82, 94 are assembled the flared end 96 forces the orifice member 100 within the recessed end 92. The portion of the recessed end 92 having internal threads mates with an externally threaded portion of the lock nut 98. The lock nut 98 is slid against the flared end 96 of the tube section 94 and threaded into engagement with the tube section 82 to lock the orifice member 100 and respective tube sections in place.

As mentioned above, the gas distribution tube preferably is formed in two sections to permit replacement of the gas flow control member to selectively vary the amount of gas fed to the burner. In the illustrated embodiment, the first and second tube sections 82, 94 are disconnected via the lock nut 98 and the orifice member 100 may be removed and replaced with an orifice member having a different size bore 102 but preferably having the same external configuration and dimensions, thereby changing the amount or pressure of gas fed to the burner 10. Thus, the inventive gas burner may be provided with a plurality of gas flow control members to permit a user to selectively control the amount of gas fed to the burner depending on a given application.

According to the invention, the gas distribution manifold is provided with means for emitting the gas in a generally radial direction. In the preferred embodiment, the distribution tube 80 is provided with a collar 110 having openings or ports 112 passing therethrough in a radial direction. The illustrated collar 110 is cylindrical with openings 112 passing through the sidewall and disposed circumferentially around the collar; however, other configurations may be used. The collar 110 as a closed end 114 and an interior in communication with the gas distribution tube 80 such that gas from the tube enters the collar 110 and exits through the radial openings 112. The openings 112 preferably are circular ports or holes, although slots or other noncircular openings could be used. The openings 112 emit the gas in a direction that is substantially perpendicular to a longitudinal axis of the distribution tube; however, the openings may be configured to emit the gas in a generally radial direction (i.e., other than a substantially perpendicular direction). The collar 110 may be secured to the gas distribution tube 80 by any suitable means, such as welding.

Figures 4, 4A:
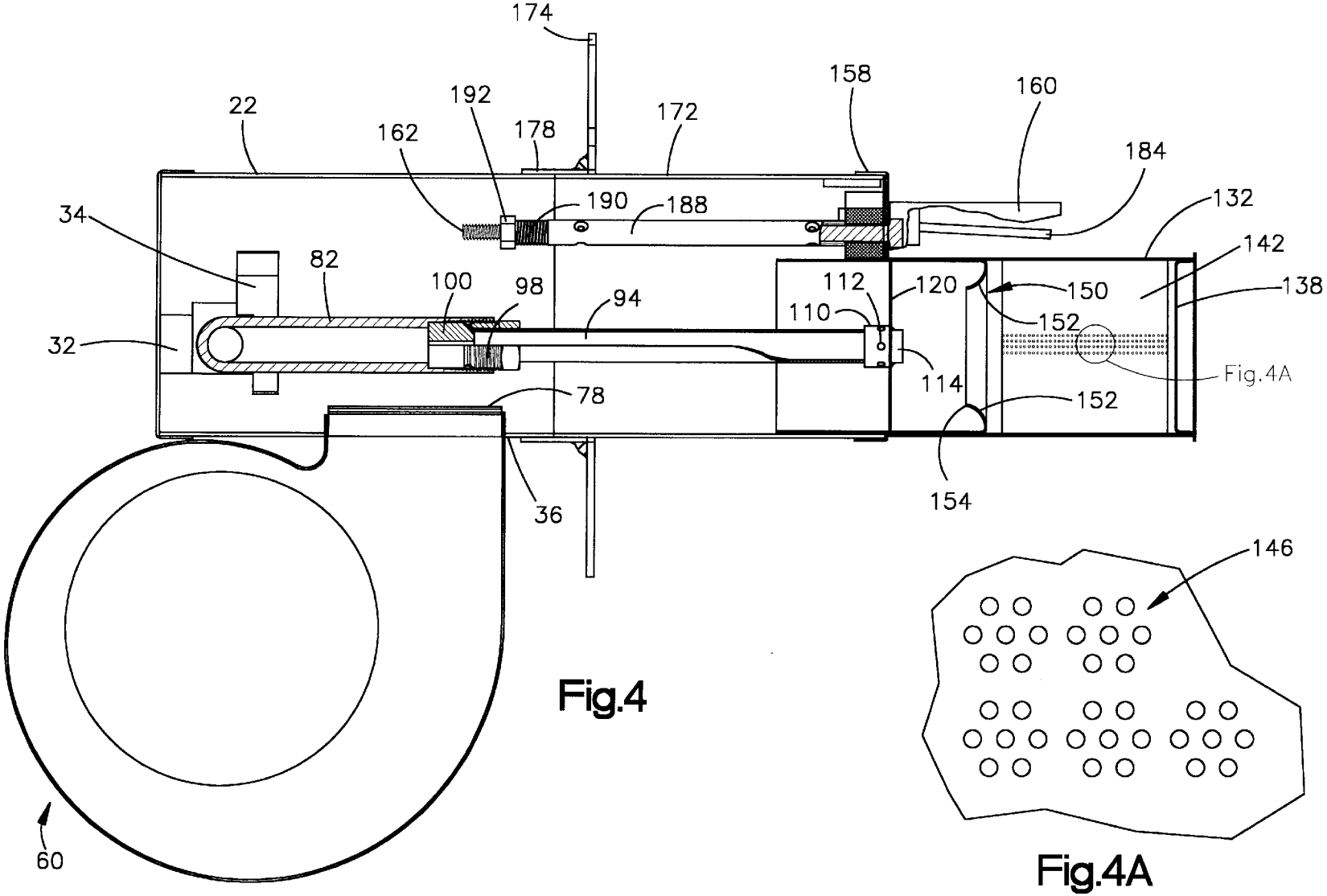
FIG. 4 is a fragmentary front elevational view, partially in section, of the gas burner shown in FIG. 1.
FIG. 4A is an enlarged view of the perforated area of the combustion head of the gas burner shown in FIG. 1.

The burner of the invention is provided with a baffle that receives gas from the distribution manifold and air from the blower flowing in somewhat well-defined streams of gas and air in the process of being mixed. The baffle also increases the velocity and reduces the pressure of the mixing gas and air as it moves downstream toward the combustion head. In the illustrated and preferred embodiment, the baffle is indicated by reference numeral 120 and comprises a baffle plate 122 having a peripheral edge 124, a central opening 126 and a plurality of openings 128. While a flat, relatively thin plate 122 is preferred, a thicker baffle having tubular-like openings could be used as well. The openings 128 preferably are in the form of circular apertures extending around the central opening 126. As seen in FIGS. 2 and 4, the baffle plate 122 is disposed adjacent to and downstream of the collar 110, for example, by securing the central opening 126 of the plate around the closed end 114 of the collar 110. Accordingly, during operation, jets of gas are emitted from the collar openings 112 and flow in a radial direction adjacent the openings 128 in the plate 122. As explained below, pressurized air from the air blower 60 simultaneously moves in a generally longitudinal direction along the gas distribution tube 80 and contacts the jets of gas emitted from the openings 112 to form the streams of mixing gas and air that flow through the openings 128 in the plate 122.

According to the preferred embodiment, the number of radial openings in the collar 110 is the same as the number of openings in the baffle plate 122. Further, the collar 110 and the baffle plate 122 preferably are positioned so that the respective openings therein are aligned in a radial direction to form pairs of corresponding openings. This arrangement results in the air from the blower 62 contacting each jet of gas emitted from a given opening in the collar 110 to form a stream of mixing gas and air that passes through a corresponding opening in the baffle plate 122. While six openings are provided in the collar and the baffle plate of the preferred embodiment, it will be appreciated that the invention is not limited to a specific number or arrangement of openings.

The gas distribution tube 80 carries a bracket 90 which is secured to the burner body 22 at the mounting portion 34 adjacent the slot 32 to lock the components together. As seen in FIG. 4, the distribution tube 80 extends forwardly of the slot 32 preferably by a distance that positions the collar 110 and the baffle 120 externally of the burner body 22 (i.e., to the right of the burner body as viewed in FIG. 4). A mounting flange assembly 170 may be used to secure the burner body 20 to a combustion head, as discussed below. The assembly 170 comprises a cylindrical body portion 172 and a peripheral flange 174, the body portion 172 extending through the central opening in the flange 174 as seen in FIG. 4. A sleeve 178 is secured to the cylindrical body portion 172 on the upstream side of the flange 174 and is telescoped over the end 30 of the burner body 22. In the illustrated embodiment, the collar 110 and the baffle 120 are disposed within the cylindrical portion 172 of the mounting flange assembly 170.

A combustion head is provided to receive the streams of mixed gas and air exiting the openings in the baffle. According to the invention, the combustion head also serves to enhance mixing of the gas and air so as to achieve an essentially homogeneous mixture that results in combustion of nearly 100% of the gas, a considerable improvement over prior art burners. The preferred combustion head construction is indicated by reference numeral 130 and is secured to the cylindrical body portion 172 of the mounting flange assembly 170, as best seen in FIG. 4. The combustion head 130 includes a cylindrical body portion 132 having a first end 134 and a second end 136, the end 136 being closed by a cap 138. The cylindrical body portion 132 has an interior 140 which communicates with the interior of the mounting flange assembly portion 172 and, most preferably, is disposed concentrically within the portion 172 and surrounds the collar 110 and the baffle plate 122. The combustion head 130 includes a locking skirt 158 secured to the end of the mounting flange assembly portion 172 to lock the components together, for example, by suitable fasteners. The upstream end 134 of the combustion head body 132 has a reduced diameter relative to the mounting flange assembly portion 172 and surrounds the baffle 120 and the collar 110 (as well as a portion of the length of the gas distribution tube 80). The air from the blower 60 thus increases in velocity and decreases in pressure as it enters the combustion head body 132 from the interior of the mounting flange assembly portion 172.

As is known in the art, the combustion head body 132 includes a perforated surface 142 that emits the mixture of gas and air to be combusted. The perforations may take various forms depending on the specific application; in a preferred embodiment they are in the form of port clusters 146 disposed in circumferential bands about the combustion head. In a burner intended to operate at 80,000 to 130,000 BTU/hour, a suitable design includes thirteen circumferential bands of port clusters, each band containing forty two clusters (or two hundred ninety four ports). The output of the burner can of course be increased or decreased by utilizing a combustion head with more, less, or different size ports, and/or by increasing or decreasing the size of the radial gas emitting ports 112 and/or the size of the orifice member 100.

In order to promote increased mixing of the gas and air, the combustion head is provided with a diffuser that forms a turbulence zone in which the streams of gas and air passing through the baffle are disrupted and agitated to achieve a homogeneous (or near homogeneous) mixture of gas and air. As explained further below, the invention achieves such mixing even though the distance between the location at which the gas is injected into the combustion head and the location at which the mixture is combusted is very short relative to prior art burners. Further, the enhanced mixing not only obtains nearly 100% combustion of the gas, but it also aids in producing a very even flame profile on the surface of the combustion head.

In the preferred embodiment, the diffuser is in the form of a diffuser ring 150 that extends radially inward a predetermined amount to form a flow restriction within the combustion head body 132. The diffuser ring 150 may be in the form of a sleeve secured within the combustion head body 132, one end of the sleeve extending radially inward to form a flow constriction that promotes turbulence. The streams of gas and air flowing through the baffle plate 122 contact the diffuser ring 150 and are partially obstructed, and most preferably are redirected back toward the baffle plate 122. The area between the downstream side of the baffle plate 122 and the diffuser ring 150 is referred to as a turbulence zone because obstructing and/or redirecting the streams disrupts and agitates the gas and air to promote thorough mixing. In addition, as the mixed gas and air passes through the diffuser ring 150 into the combustion head 130 adjacent the perforated area 142, its velocity decreases and its pressure increases, which aids in obtaining level loading of the ports in the combustion head and results in a more even flame.

As seen in FIG. 4, in the preferred embodiment the diffuser ring 150, in addition to extending radially inward from the combustion head body 132, also is angled slightly toward the baffle plate 122 to promote turbulence. However, the diffuser ring may extend inward from the combustion head in a substantially perpendicular direction or be angled slightly away from the baffle plate as long as an acceptable level of mixing is achieved. In the most preferred embodiment, the diffuser ring 150 includes an arcuate portion 152 terminating in a throat 154. The arcuate configuration is believed to further enhance turbulence and mixing by causing the streams of gas and air flowing through the baffle plate 122 to undergo a swirling motion. However, the diffuser ring portion extending to the throat may be flat, i.e., straight in crosssection rather than arcuate.

An igniter 180 is provided to ignite the mixture of gas and air exiting the combustion head through the perforated surface 142. The combustion head 130 includes an igniter shield 160 having a pair of attachment posts 162 passing through openings formed in the locking skirt 158 of the combustion head 130. The igniter 180 is mounted to the attachment posts 162 and includes a body 182 and a tip 184. The igniter 180 includes a pair of wires 186 which are connected to a suitable source of electricity for energizing the igniter upon actuation of the burner 10. A pair of sleeves 188 receive the threaded attachment rods 162 and a pair of springs 190 are disposed over the end of the rods, while a pair of locking nuts 192 secure the components together.

The igniter tip 184 preferably is disposed in close proximity to the exterior of the perforated surface 142 of the combustion head 130 to achieve quick, consistent lighting. Additionally, the life of the igniter is increased by such placement because it is located in the cooler zone of the flame. In the preferred embodiment, the distance between the igniter tip 184 and the perforated surface 142 is preferably from about 0.20 to about 0.40 inches, and most preferably about 0.30 inches. One manner of positioning the igniter 180 such that the tip 184 is in close proximity to the perforated surface 142 of the combustion head is to angle the igniter from the body 182 as shown in FIG. 4. However, other configurations may be used to achieve the close spacing between the igniter tip and the combustion head.

Several mechanisms are provided for controlling operation of the burner 10. The gas valve 230 attached to the inlet 86 of gas distribution tube 80 regulates the pressure of the gas received from a supply to the desired operating (i.e., manifold) pressure. A significant benefit of the inventive burner is that it operates efficiently at very low gas pressures, and thus is ideal for use with low gas pressures which may be encountered, for example, in particular geographic areas such as the eastern portion of the United States, areas that utilize wooden gas mains, etc. The burner can be used with a supply line gas pressure as low as 4.0 inches water column, for both natural and LP gas. For optimal operation, the valve 230 is set to achieve an operating gas pressure of 3.0 inches water column, as opposed to the industry standard of an operating pressure of 3.5 inches water column. Further, as noted above, the burner operates at this optimal pressure for both natural and LP gas, which provides increased flexibility as compared to prior art burners. The gas valve 230 is a fast opening type control valve, e.g., a Honeywell VR8205A control valve.

An air pressure/proving switch 200 is provided to ensure that the air blower operates to create a predetermined amount of air pressure within the burner housing. Upon the pressure reaching that amount, the switch 200 closes to direct power from a transformer 210 to an ignition gas control device 220. While air pressure/proving switch 200 senses pressure within the burner housing, alternative sensing arrangements may be used, for example, a device that senses pressure in the air blower housing. While any conventional transformer may be used, a 30VA transformer is optimal.

The purpose of the ignition control device 220 is to monitor lighting of the mixed gas and air exiting the combustion head by sensing the presence of a flame, as is known in the art. A suitable control is a Honeywell S89L control that provides a three-try, two second ignition activation period with a four second lockout. Thus, activating the burner energizes the air blower and the transformer 210. Once the air pressure/proving switch 200 detects sufficient air pressure in the burner housing, it closes to permit power from the transformer 210 to reach the ignition gas control device 220. The igniter is energized for a warm-up period at the end of which the gas valve 230 is opened for the timed trial for ignition. The ignition is turned off and flame sensing begins. If flame is sensed, the gas valve remains open until the burner is shut down. If no flame is sensed, the gas valve is closed and the number of ignition trials checked. Should there be no flame after three trials, the ignition control locks out and the burner must be reset.

As explained above, the air delivered by the air blower begins mixing with the gas delivered by the manifold and forms streams that pass through the baffle. These streams contact the diffuser and undergo considerable turbulence which results in very thorough mixing. As can be seen from the preferred embodiment shown in FIG. 4, thorough mixing of the gas and air may be achieved in a short mixing zone. The gas-emitting openings, which are disposed immediately adjacent the baffle in the preferred embodiment, are located relatively close to the beginning of the combustion head ports.

In prior art burners, the length-to-diameter ratio of the mixing zone is typically on the order of 10 to 1, which naturally results in a long burner. In the invention, the length-to-diameter ratio of the mixing zone may be 1 to 1, or even less than 1 to 1. For example, in a preferred embodiment, the baffle has a diameter of 2.55 inches and includes six openings each having a diameter of 0.75 inches; the baffle is located 1.14 inches from the diffuser throat 154 and 1.45 inches from the opposite end of the diffuser portion 152, while the diffuser throat has a diameter of 1.75 inches. As seen, the combustion head diameter is slightly larger than the baffle diameter, e.g., 2.59 inches. This dimensional configuration provides a mixing zone with a length-to-diameter ratio of about 2 to 3. If desired, the distance between the baffle and diffuser can be increased and a good homogeneous mixture of gas and air still obtained; however, decreasing the distance may adversely affect mixing depending on the specific application. Also, it is desired to position the gas-emitting openings very close to the baffle as shown, although increasing the distance may not prevent good mixing and combustion. Similarly, the diffuser throat diameter and combustion head diameter may be varied. Finally, while the preferred embodiment has a cylindrical configuration and thus is described in terms of relative diameters, it will be recognized that non-cylindrical components may be used with the relative flow areas thereof selected to achieve thorough mixing.

It is apparent that the burner of the invention is more compact and uses less material than prior art burners, and also may be used with many different appliances. In addition, due to the thorough mixing of the gas and air, and the pressure reduction achieved by the baffle and diffuser, the burner of the invention produces a very even flame over essentially the entire length of the combustion head. Many prior art burners must utilize special inserts, such as cones or orifice liners, in the combustion head in order to achieve a flat flame profile. As such, the burner is easier and less expensive to manufacture than many prior art burners. Further, because the gas is not mixed with air in or through the air blower, the blower does not need to be completely air tight; only the combustion head need be air tight. This feature further reduces manufacturing costs. Also, it is easy to seal the burner head against gas leakage because the inlet end of the burner operates at a higher pressure than the combustion head, with the pressure decreasing continuously in a downstream direction from the air blower outlet to the combustion head. This feature, along with the flat frame profile, also reduces noise during operation. Accordingly, the present invention improves considerably over conventional power gas burner constructions.

Although the invention has been described in its preferred form with a certain degree of particularity, it is understood that the present detailed disclosure is made only by way of example and that numerous changes in the details of construction, operation and the combination and arrangement of parts may be made without departing from the spirit and the scope of the invention as hereinafter claimed.

What is claimed is:

1. A gas burner comprising:

a burner housing having an interior;

an air blower having an outlet communicating with the interior of the burner housing;

a gas distribution manifold having an inlet for receiving gas and an outlet for emitting gas in a generally radial direction;

a baffle disposed adjacent to the outlet of the manifold and extending in a generally radial direction with respect to a longitudinal axis of the manifold, the baffle including a plurality of openings disposed around the manifold outlet wherein air from the air blower mixes with gas emitted radially from the manifold outlet and passes through the openings in the baffle;

a diffuser disposed adjacent to the baffle for contacting the mixed gas and air passing through the baffle; and a combustion head located adjacent to the burner housing in communication with the interior of the burner housing, the combustion head including perforations for emitting mixed gas and air.

2. A burner according to claim 1, wherein the combustion head is a separate element from the burner housing and attached thereto, and further comprising an igniter secured to the combustion head for igniting the mixed gas and air emitted from the perforations.

3. A burner according to claim 1, wherein the gas distribution manifold comprises a gas distribution tube including said outlet, and said outlet is located on an upstream side of the baffle and the diffuser is located on a downstream side of the baffle, and wherein gas is emitted from a plurality of openings provided in the distribution tube outlet and mixes with air from the blower and the mixed gas and air passes through the plurality of openings in the baffle.

4. A burner according to claim 3, wherein the baffle is a plate, and the diffuser extends radially inward a predetermined distance from an interior of the combustion head and creates turbulence in the mixed gas and air passing through the openings in the baffle plate to produce a substantially homogeneous mixture of gas and air.

5. A burner according to claim 3, wherein the distribution tube has a collar attached thereto and said plurality of openings are formed in the collar.

6. A burner according to claim 5, wherein the baffle is secured to the collar and each of said plurality of openings in the baffle is aligned with a corresponding one of the plurality of openings in the collar.

7. A burner according to claim 3, wherein the number of openings in the distribution tube outlet is the same as the number of openings in the baffle.

8. A burner according to claim 7, wherein six openings are provided in the distribution tube outlet and the baffle, and the openings are circular ports.

9. A burner according to claim 1, wherein the gas manifold outlet has a plurality of radial openings aligned with the openings in the baffle.

10. A burner according to claim 1, wherein the diffuser extends radially inward and toward the baffle.

11. A burner according to claim 1, wherein the diffuser is arcuate in cross-section and necks toward the baffle.

12. A burner according to claim 1, wherein the burner housing and combustion head each include a cylindrical body, and the baffle and diffuser are disposed against an interior of the body of the combustion head.

13. A burner according to claim 1, wherein the gas distribution manifold comprises a gas distribution tube including a first section defining the gas inlet, a second section removably attached to the first section and defining the gas outlet, and a gas flow control member positioned between said first and second sections to regulate gas flow through the gas distribution tube.

14. A burner according to claim 13, wherein said first and second sections of the gas distribution tube are attached by a threaded connection, and the gas flow control member is an orifice member slidably received within one of said sections and locked in place upon attaching said sections.

15. A burner according to claim 14, wherein said first section has a threaded end portion and said second section carries a threaded nut that engages said threaded end portion.

16. A burner according to claim 13, further comprising a plurality of gas flow control members each of which is an orifice member having a different size flow orifice, the orifice members being interchangeable to vary flow through said gas distribution tube.

17. A burner according to claim 1, further comprising a gas pressure control valve attached to the gas distribution tube inlet and an air metering plate disposed between the blower outlet and the interior of the burner housing.

18. A burner according to claim 1, wherein the burner housing and the combustion head are separately formed elements, and further comprising a mounting flange assembly connecting the burner housing to the combustion head and including a tubular body portion and a peripheral mounting flange.

19. A process for producing a substantially homogeneous mixture of gas and air in a burner, the process comprising steps of:

providing a burner having a burner housing that includes an interior and a combustion head in communication with the interior;

feeding gas through a gas distribution manifold and causing the gas to exit the manifold adjacent to the combustion head in a generally radial direction;

forcing pressurized air into the interior of the burner housing so as to flow in a generally axial direction along a longitudinal axis toward said combustion head, the air mixing with the gas exiting the manifold in said generally radial direction;

directing the air and gas exiting in said generally axial direction through a baffle including a plurality of openings which reduce the pressure of the air and gas; and directing at least a portion of the air and gas passing through the openings in the baffle against a diffuser which redirects the portion to create turbulence and provide a substantially homogeneous mixture of gas and air to said combustion head.

20. A process according to claim 19, wherein the gas distribution manifold is a tube and the gas exits the tube through a plurality of radial openings and is combined with the air flowing in said generally axial direction to form streams of gas and air that pass through the openings in said baffle.

21. A process according to claim 20, wherein the number of openings in the tube is the same as the number of openings in the baffle, and the gas exiting one of said tube openings mixes with air and passes through a corresponding one of said baffle openings.

22. A process according to claim 19, wherein the diffuser extends radially inward and necks toward the baffle plate and the gas and air undergo turbulence upon contact with the diffuser.

23. A process according to claim 19, wherein a gas inlet valve is provided and regulates the pressure of the gas fed to the distribution tube to an operating pressure of 3.0 inches water.

24. A process according to claim 19, further comprising the step of providing an igniter with an ignition tip disposed immediately adjacent to the combustion head for lighting the gas and air.

25. A gas burner comprising:

an air blower having an outlet communicating with an interior of the burner;

a gas distribution manifold having an inlet for receiving gas and an outlet for emitting gas in a generally radial direction within the burner interior;

a baffle disposed adjacent to the manifold outlet and extending in a generally radial direction with respect to a longitudinal axis, the baffle including a plurality of openings disposed around the manifold outlet wherein air from the air blower mixes with gas emitted from the manifold outlet and passes through the openings in the baffle;

a diffuser having an inlet side for contacting the mixed gas and air passing through the baffle and an outlet side for emitting a combustible mixture of gas and air; and a combustion head in communication with the outlet side of the diffuser and including perforations for emitting the combustible mixture of gas and air;

wherein the burner has a mixing zone in which the gas and air are substantially completely mixed, the mixing zone having a length extending from the manifold outlet to the outlet side of the diffuser and a width extending transversely to the length, and wherein the ratio of the length to width of the mixing zone is about 1 to 1.

26. A burner according to claim 25, wherein the ratio is about 2 to 3.

27. A burner according to claim 25, wherein the manifold outlet is located on an upstream side of the baffle, and the diffuser is located on a downstream side of the baffle and extends radially inward and necks toward the baffle.

* * * * *